2/25/86 XR 4,572,078

United States Patent [19]

Bell

[11] Patent Number: 4,572,078

[45] Date of Patent: Feb. 25, 1986

[54] CASED CARTRIDGE AMMUNITION IGNITION BOOSTER

[75] Inventor: Frank H. Bell, Logan, Utah

[73] Assignee: Morton Thiokol, Inc., Chicago, Ill.

[21] Appl. No.: 608,919

[22] Filed: May 10, 1984

Related U.S. Application Data

[63] Continuation of Ser. No. 368,334, Apr. 14, 1982, abandoned.

[51] Int. Cl.[4] ..... F42B 5/26; F42B 8/00

[52] U.S. Cl. ..... 102/464; 102/430; 102/431; 102/443; 102/465; 102/466; 102/200; 102/470; 102/285

[58] Field of Search ..... 102/430–435, 102/443, 200, 464–468, 420, 285

[56] References Cited

U.S. PATENT DOCUMENTS

| | | | |
|---|---|---|---|
| 2,394,249 | 2/1946 | McGahey, Jr. | 102/430 |
| 3,392,673 | 7/1968 | King | 102/202 |
| 3,927,616 | 12/1975 | Axelrod et al. | 102/464 |
| 3,987,731 | 10/1976 | Brzuskiewicz | 102/431 X |
| 4,098,193 | 7/1978 | Schroeder | 102/435 |
| 4,179,992 | 12/1979 | Ramnarace et al. | 102/470 |
| 4,334,477 | 6/1982 | Axelrod et al. | 102/435 |
| 4,363,273 | 12/1982 | Luebben et al. | 102/431 |
| 4,365,558 | 12/1982 | Lippler et al. | 102/431 |

*Primary Examiner*—Edward A. Miller
*Attorney, Agent, or Firm*—Gerald K. White

[57] ABSTRACT

A cased cartridge ammunition ignition booster includes a film of booster propellant that is case-bonded without insulation or liner to the inside wall and base of an ordinary brass, steel or plastic cartridge case and ignited by a conventional primer. Flame spread occurs from the case wall inward through the non case-bonded propellant bed, that is, the bed of the propelling charge.

11 Claims, 2 Drawing Figures

PRIOR ART

CASED CARTRIDGE AMMUNITION IGNITION BOOSTER

This application is a continuation of application Ser. No. 368,334, filed Apr. 14, 1982, now abandoned.

BACKGROUND OF THE INVENTION

1. Field of the Invention

The present invention relates to an improvement in munitions, and in particular, the ignition systems for fixed and semi-fixed gun and cannon ammunition for enhancing the flame spread throughout the propellant charge.

2. Description of the Prior Art

Smaller calibers of artillery ammunition, known as fixed ammunition, are normally assembled as a compact unit. The unit includes a case that contains the propellant, a projectile or bullet attached to one end of the case, and a primer inserted in the other end. The case may be made of brass, steel or a plastic. The propellant is also known as smokeless powder or gunpowder.

Semifixed ammunition differs from fixed ammunition in that the projectile is separable from the case to permit an increase or decrease in the propellant charge to be made, thereby to effect an adjustment in the range.

The history of the development of ignition systems for fixed and semifixed gun and cannon ammunition shows a progression from percussion cap to percussion primer, from percussion primer to electric or percussion primer with a flash tube to a booster filled igniter flash tube affixed to an electric or percussion primer. Tank cannon ammunition cartridge cases usually incorporate an electric primer together with a booster propellant filled igniter flash tube located on the central axis of the cartridge case with blast vent holes located in rows (3 to 5) along the side or sides of the flash tube. This system has severe limitations when it is employed to ignite composite gun/cannon propellants, especially low vulnerability ammunition, (LOVA) propellants. A principal limitation is that of the quality of the propellant bed permeation by booster propellant flash. Uniformity is not easily obtained. Other disadvantages of ammunition cartridge cases utilizing flash tubes are flash tubes are expensive, they are difficult to assemble, and they are difficult to pack with the propellant charge with the flash tube in place. Thus, there is a need and a demand for a better propellant charge ignition booster for cased cartridge ammunition, a booster which in operation does not limit flash via vent holes in a flash tube.

SUMMARY OF THE INVENTION

An object of the invention is to provide a cased cartridge ammunition ignition booster which is characterized by a significant increase in surface area from which flame may more effectively permeate the bed of the propellant charge thereby to enhance flame spread.

Another object of the invention is to provide such a booster that may be utilized with cases made of brass, steel, plastic, fabric, paper, etc.

A further object of the invention is to provide such a booster that may be used with conventional primers.

In accomplishing these and other objects of the invention, the booster propellant (ignition aid) is removed from the flash tube and relocated on the inside walls and base of the cartridge case as a thin film of case-bonded nitrocellulose (7 to 13.6% Nitrogen) or a case-bonded composite propellant without case insulation or liner.

The propellant film may be extended to the base of the bullet or projectile. Also, the propellant film may have embedded in it grains of some other conventional colloidal gun propellant or crystalline oxidizer.

Alternatively, the booster propellant film may be used to augment a centrally located booster propellant filled flash tube.

BRIEF DESCRIPTION OF THE DRAWINGS

Having summarized the invention, a detailed description follows with reference being had to the accompanying drawings which form part of the specification, of which.

DESCRIPTION OF THE PRIOR ART

Figure 1:
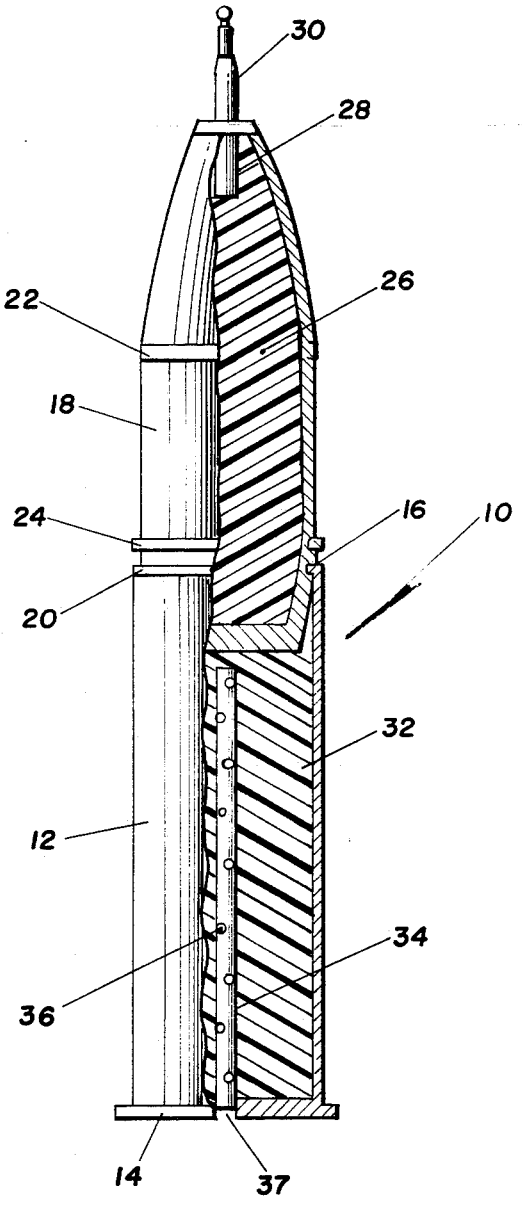
FIG. 1 is an illustration with parts broken away of an assembled fixed round of prior art ammunition, for example, 75 mm. ammunition.

The prior art assembled fixed round of ammunition indicated at 10 in FIG. 1 comprises a metal container or cartridge case 12 made of brass or steel. Cartridge case 12 is closed at one end 14 and has an opening 16 at the other end for receiving a bullet or projectile 18 such as, for example, as a high explosive shell. A crimp 20 adjacent the opening 16 of cartridge 12 is provided to retain the projectile 18 in place. Associated with the projectile 18 is the customery bourrelet 22 and rotating band 24. The projectile 18 contains therein a bursting charge 26, of TNT, for example, and further includes an adapter and booster 28 and an insertable fuze 30 that may be of the point detonating type.

A propelling charge of non-case bonded propellant 32 is contained within cartridge case 12. A primer or flash tube 34 comprising a metal tube having vent holes 36 therein is centrally located within the propellant 32. Vent holes 36 are located in rows, usually 3 to 5, along the side of tube 34. Flash tube 34 contains a sensitive explosive or booster propellant in an amount needed to bring about complete ignition of the propellant 32. When the primer 34 is fired, as by the actuation of a conventional primer of the percussion or other type associated with a perforation 37 in the closed end 14 of cartridge case 12, flame is emitted through vent holes 36 in tube 34 and spreads radially outwardly through the bed of propellant 32. The spread of flame evenly throughout the bed of the charge is desired. Uniformity of flame spread throughout the propellant 32, however, is not easily obtained. Limiting the flash by the use of vent holes 36 through which the flash must pass seriously impairs uniformity of flame permeation of the bed of propellant 32.

DESCRIPTION OF THE PREFERRED EMBODIMENT

Figure 2:
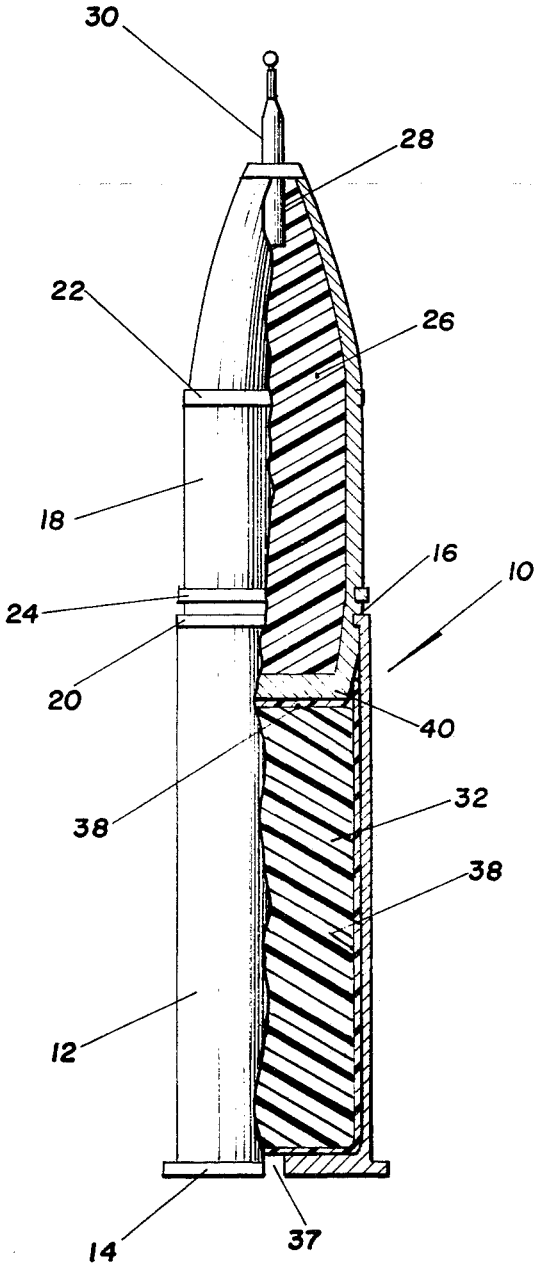
FIG. 2 is an illustration with parts broken away of an assembled fixed round of ammunition according to the invention.

For convenience of illustration, parts in FIG. 2 that correspond to parts in FIG. 1 have been designated by the same reference numerals.

In the assembled fixed round of ammunition according to the embodiment of the present invention illustrated in FIG. 2, the booster filled igniter flash tube 34 has been dispensed with and the sensitive explosive or booster propellant is relocated on the inside walls and base of the cartridge 12 as a thin film 38 of case-bonded nitrocellulose comprising 7 to 13.6% of Nitrogen or a case-bonded composite propellant without case insulation or liner. In all other respects, assembled round of ammunition illustrated in FIG. 2 may be identical to that illustrated in FIG. 1.

The booster propellant film 38 may be extended to the base of the bullet or projectile 18, and, if desired, may be applied to the base 40, also of the bullet or projectile 18. Additionally, the propellant film 38 may have embedded in it grains of some other conventional colloidal gun propellant or crystalline oxidizer such as RDX (trimethylene trinitramine), HMX (tetramethylene tetranitramine), AP (ammonium perchlorate), AN (ammonium nitrate), nitroguanadine, etc.

By way of example and not limitation, the booster propellant film 38 may have a thickness of not less than 0.025 inches (0.635 mm.). A booster propellant film 38 of this thickness would be suitable for 50 caliber, 20 mm. ammunition. Thicker films providing longer burning times with appropriate burning rate would be used as required to effect complete ignition of the propelling charge 32 in ammunition rounds of larger caliber.

The advantage afforded by this relocation of the booster propellant is that there is effectuated a significant increase in surface area from which, upon firing of the booster propellant, flame may spread, radially inwardly, to permeate the bed of the propelling charge 32 thereby enhancing flame spread.

The cartridge case 12 employed in practicing the invention may be a conventional brass or steel case but may also be made of other materials such as plastic, fabric and pressed paper. Conventional primers may be used for firing the booster propellant thin film 38, for example, a percussion type primer associated with perforation 37 in the closed end of cartridge case 12 and that is fired when struck by the firing pin of the weapon. Other types of primers that may be employed are the electric primer that is fired by heat generated when an electric current passes through a resistance wire, or the type of primer that is fired by friction.

The booster propellant film 38 may be applied to the inside walls and base of the cartridge case 12 in any suitable manner. A preferred way is to pour into the cartridge case 12 a solvent type double-base propellant that is not cured, with the propellant containing 20–40% nitroglycernine, for example, with acetone used as a solvent. The propellant film 38 may have embedded in it grains of some other conventional gun propellant or crystalline oxidizer, as described hereinbefore. The cartridge case 12 is turned upside down to ensure complete coverage of the inside walls and base and to allow the propellant to drain. When drained, the cartridge case 12 is heated to dry at an appropriate temperature that is not hot enough to ignite the thin film 38 of booster propellant that has adhered to the side walls and base.

The material selected for the cartridge case 12 may be selected, if desired, for its affinity to the booster propellant film 38 thereby to effect a good bond.

In accordance with the invention, the booster propellant film 38 may be low vulnerability (LOVA) composite propellant thus reducing vulnerability of the ammunition system to external threat. It is noted that most booster propellant used in ammunition is black powder. While black powder is a low explosive, it is a dangerous fire and explosion hazard, being sensitive to heat and deflagrating rapidly. Black powder is classified by the U.S. Department of Transportation as a "Class A Explosive Solid".

The booster propellant film 38 may be designed to attain the noise level of a blank-fire round thus enabling a saving on blank-fire propellant.

Thus, there has been provided in accordance with the invention an improved case cartridge ammunition ignition booster comprising a booster propellant film 38 on the inside walls and base of the cartridge case 12. This booster propellant film 38 may be used to replace the prior art booster propellant flash tube 34, as shown in FIG. 1, that is located on the central axis of the cartridge case 12.

It will be understood that, if desired, a booster propellant film 38 may be employed on the inside walls and base of the cartridge case 12 of a prior art round of ammunition, as illustrated in FIG. 1, to augment the igniting effect on the propelling charge 32 of the centrally located booster propellant filled flash tube 34.

What is claimed is:

1. The combination of a cased cartridge and an ammunition ignition booster comprising, a cartridge case for cased cartridge ammunition, said cartridge case having inside walls and an open end, and an ignition booster for the cased cartridge ammunition comprising a film of solvent soluble nitrocellulose containing 7 to 13.6% Nitrogen applied to said inside walls of said cartridge case by pouring into said open end of said cartridge case a solvent type double-base propellant that is not cured, with the propellant containing 20–40% nitroglycerine and with acetone used as a solvent, turning the cartridge case upside down to allow the propellant to drain, and when drained, heating the cartridge case to dry the film of propellant that has adhered to said inside walls.

2. A combination as specified in claim 1 wherein said cartridge case also includes an inside base and where a film of solvent soluble nitrocellulose containing 7 to 13.6% Nitrogen is also applied to said base.

3. A combination as specified in claim 1 further including means associated with said inside walls of said cartridge case for firing said film of nitrocellulose.

4. A blank-fire round of ammunition comprising, a cartridge case having an open end, a closed end and inside walls including a base, a film of solvent soluble nitrocellulose containing 7 to 13.6% Nitrogen applied to said inside walls and said base of said cartridge case by pouring into the open end of said cartridge case a solvent type double-base propellant that is not cured, with the propellant containing 20–40% nitroglycerine and with acetone used as a solvent, turning the cartridge case upside down to allow the propellant to drain, and when drained, heating the cartridge case to dry the film of propellant that has adhered to said inside walls, a propellant charge contained in said cartridge case, and means associated with the closed end of said cartridge case for firing said film of nitrocellulose.

5. A round of ammunition comprising, a cartridge case having an open end, a closed end and inside walls including a base, a film of solvent soluble nitrocellulose containing 7 to 13.6% Nitrogen applied to said inside walls and said base of said cartridge case by pouring into said open end of said cartridge case a solvent type double-base propellant that is not cured, with the propellant containing 20–40% nitroglycerine and with acetone used as a solvent, turning the cartridge case upside down to allow the propellant to drain, and when drained, heating the cartridge case to dry the film of propellant that has adhered to said inside walls, a propellant charge contained in said cartridge case, a projectile received within the open end of said case, and means associated with the closed end of said cartridge case for firing said film of nitrocellulose.

6. A round of ammunition as specified in claim 5 wherein said film of booster propellant has embedded therein, grains of a crystalline oxidizer.

7. A round of ammunition as specified in claim 5 wherein said projectile has a base, said projectile being received within the open end of said cartridge case and also having a film of nitrocellulose containing 7 to 13.6% Nitrogen applied thereto.

8. A round of ammunition as specified in claim 5 further including a booster propellant ignition flash tube having vent holes therein, said flash tube being located on the central axis of said cartridge case and extending from the base thereof toward said projectile.

9. A round of ammunition as specified in claim 8 wherein said projectile has a base, said projectile base being received within the open end of said cartridge case and also having a film of nitrocellulose containing 7 to 13.6% Nitrogen applied thereto.

10. A round of ammunition as specified in claim 9 wherein said film of nitrocellulose has embedded therein grains of a crystalline oxidizer.

11. A cased cartridge ammunition ignition booster for a round of ammunition comprising, a cartridge case for cased cartridge ammunition, said cartridge case having an open end, inside walls and being made of brass, and a film of solvent soluble nitrocellulose containing 7 to 13.6% Nitrogen applied to said inside walls of said cartridge case by pouring into said open end of said cartridge case a solvent type double-base propellant that is not cured, with the propellant containing 20–40% nitroglycerine and with acetone used as a solvent, turning the cartridge case upside down to allow the propellant to drain, and when drained, heating the cartridge case to dry the film of propellant that has adhered to said inside walls.

* * * * *